United States Patent [19]

McGeary

[11] Patent Number: 4,545,633

[45] Date of Patent: Oct. 8, 1985

[54] WEATHERPROOF POSITIVE LOCK CONNECTOR

[75] Inventor: Peter G. McGeary, Hobe Sound, Fla.

[73] Assignee: Whittaker Corporation, Calif.

[21] Appl. No.: 516,404

[22] Filed: Jul. 22, 1983

[51] Int. Cl.[4] ..... H01R 13/44

[52] U.S. Cl. ..... 339/42; 339/91 R; 339/94 C; 339/177 E; 339/258 R

[58] Field of Search ..... 339/253 R, 255 R, 258 RR, 339/258 R, 42, 94, 177, 90 R

[56] References Cited

U.S. PATENT DOCUMENTS

| | | | |
|---|---|---|---|
| 3,491,326 | 1/1970 | Pfister | 339/42 |
| 3,605,069 | 9/1971 | Dorell | 339/90 R |
| 3,953,098 | 4/1976 | Avery et al. | 339/177 R |
| 4,017,139 | 4/1977 | Nelson | 339/177 R |
| 4,377,320 | 3/1983 | Lathrop et al. | 339/177 R |

FOREIGN PATENT DOCUMENTS

| | | | |
|---|---|---|---|
| 169521 | 11/1951 | Fed. Rep. of Germany | 339/42 |
| 1202374 | 10/1965 | Fed. Rep. of Germany | 339/42 |

*Primary Examiner*—Gil Weidenfeld
*Assistant Examiner*—David L. Pirlot
*Attorney, Agent, or Firm*—Donald E. Nist

[57] ABSTRACT

The device comprises a male plug and a female receptacle, each of which has a housing with an electrically insulative central tubular component and a cavity extending through and adapted to receive an electrical conduit. When the plug and receptacle are joined together, electrical conduit ends disposed in the plug and receptacle are electrically interconnected. Both the plug and receptacle also include components for securing the conduits in place and components for thermally sealing the conduits therein against atmospheric conditions. The male plug has flexible fingers extending from its front end while the receptacle has its tubular member dimensioned such that it spreads the fingers as the plug and receptacle are joined together. The receptacle tubular member has recesses into which the finger ends snap to hold the plug and receptacle together. Tabs slide over these recesses to releasably lock the fingers in the recesses. The fingers are retractable from the recesses, thus permitting uncoupling of the plug and receptacle, by sliding the outer sleeve of the receptacle rearwardly against an internal spring and carrying with it the locking tabs to a rear unlocked position. The device is simple, durable and highly effective. It is utilized in interconnecting nuclear reactor cable components and in other high temperature corrosive environments. The device is also useful in high frequency electrical conductor applications.

5 Claims, 5 Drawing Figures

WEATHERPROOF POSITIVE LOCK CONNECTOR

BACKGROUND OF THE INVENTION

1. Field of the Invention

The present invention generally relates to electrical components and more particularly to an improved thermal and corrosion resistant positive locking connector device for electrical conduits.

2. Prior Art

Conduit connectors for various specialty applications, such as nuclear reactors, and high frequency microwave electronic components usually provide screw on engagement of the two portions of the connector. In many instances, although the applications in reality require protection of the conduits against weather and other corrosive conditions and against heat, the connectors are not designed to provide such protection. In many applications repeated movement of the connectors, as in use in vehicles or the like which undergo vibration results in loosening of the connector components, permitting thermal and corrosion access and eventually impairing the electrical connection provided by the connector. Accordingly, there is a need for a relatively inexpensive, highly efficient conduit electrical conduit connector which positively locks in a simple manner and cannot be separated by vibration or movement. The connectors should be weatherproof, corrosion resistant and hermetically sealed and should be capable of being welded to stainless steel jacketed coaxial cables and the like. The connector should be adaptable for use in nuclear reactors, and in high frequency microwave components and the like.

SUMMARY OF THE INVENTION

The improved weatherproof positive lock connector of the present invention satisfies all the foregoing needs. The connector is substantially as set forth in the Abstract above. Thus, it comprises a male plug and female receptacle, each having a housing with a central tubular electrically insulated component therein. Each such component has a cavity extending longitudinally thereto, which cavity is adapted to receive an electrical conduit. When the plug and receptacle are joined together, electrical conduit ends disposed therein are electrically interconnected. They are also effectively protected due to the presence of sealing elements disposed in the plug and receptacle which protect the conduits aginast corrosion, atmospheric conditions and heat.

The plug and the receptacle each contain a sleeve. The receptacle's sleeve is spring biased forward and is retractable, carrying with it locking tabs which extend over locking recesses in the outer surface of the tubular component of the receptacle. The tabs are spring biased into the locked position but are movable into the unlocked position by flexible fingers forming part of the male plug when the plug and receptacle are engaged. The receptacles tubular component is of a diameter to spread the fingers during such engagement, the spread fingers then pressing against and reactivating the locking tabs until the finger ends spring into the locking recesses, whereupon the tabs are biased into the locked position to hold the fingers in the recesses and thus can keep the plug and receptacle locked together. This positive locking mechanism will not unlock due to movement of vibration of the connector and thus overcomes the principal defect in conventional connectors of this type. Moreover, the connector can be locked together and unlocked much more rapidly than conventional connectors which require screwing together of the elements thereof in order to fully engage them. Various features of the present invention are set forth in the following detailed description and drawings.

DRAWINGS

Figure 1:
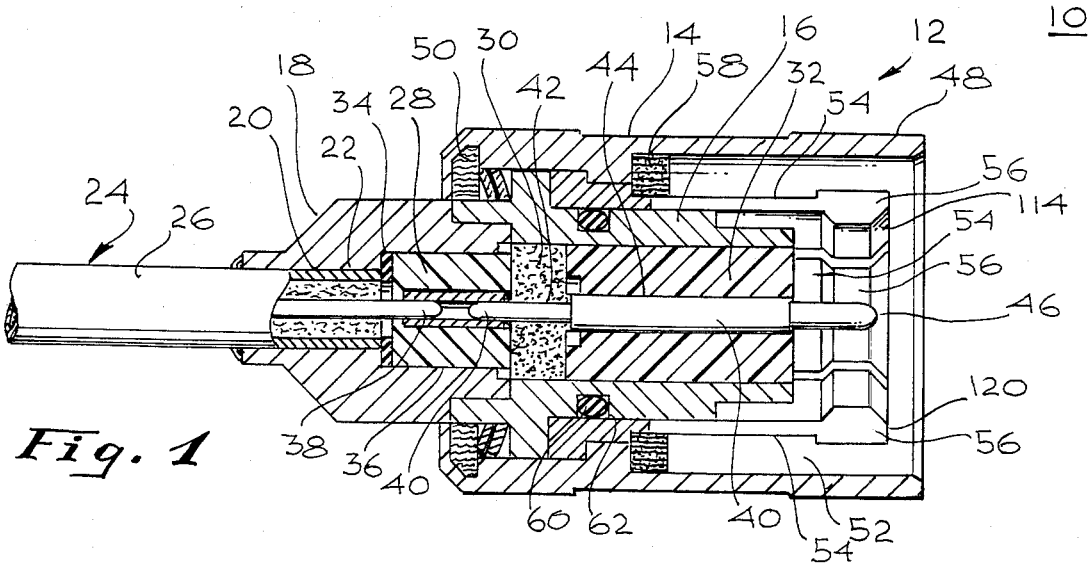
FIG. 1 is a schematic vertical cross-section of a preferred embodiment of the male plug component of the improved positive lock connector device of the present invention.
Figure 2:
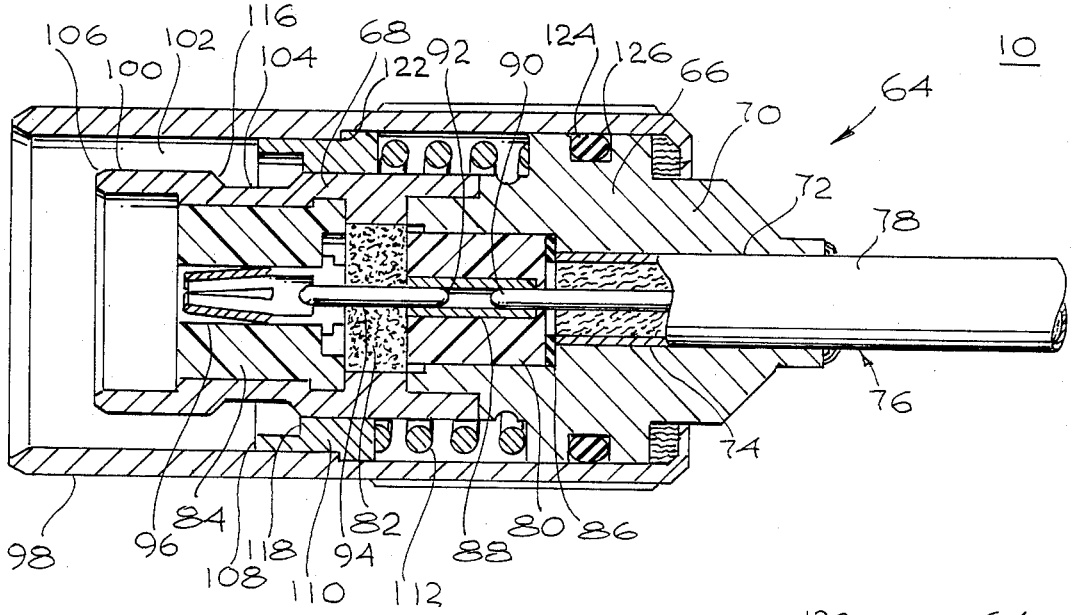
FIG. 2 is a schematic vertical cross-section of a preferred embodiment of the female receptacle component of the improved positive lock connector device of the present invention.
Figure 4:
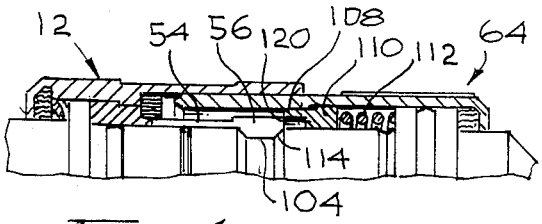
Figure 5:
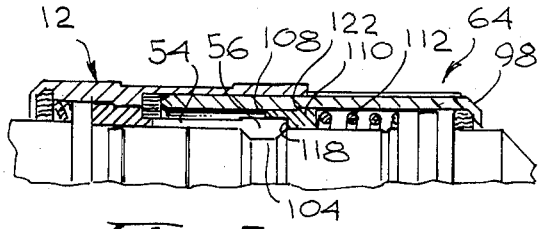

FIG. 4 is a reduced schematic fragmentary side elevation, partly in section, of the plug and receptacle components of FIGS. 1 and 2 when fully engaged but before the connector device is positively locked; and, FIG. 5 is a reduced schematic fragmentary side elevation partly in section, of the plug and receptacle components of FIGS. 1 and 2 fully engaged and with the connector device positively locked.

DETAILED DESCRIPTION

FIG. 1

Now referring more particularly to FIG. 1 of the accompanying drawings, a preferred embodiment of the male plug component of the improved weatherproof, snap-on, positive lock connector device of the present invention is schematically shown therein with the end of an electrical conduit inserted therein. Thus, connector device 10 includes male plug 12 which has a housing 14. Housing 14 includes a central elongated tubular component 16 which is preferably of metal and has a rear end fitting 18 bearing a central passageway 20 therein adapted to receive the end 22 of an electrical conduit 24. Fitting 18 is adapted to be welded to or otherwise connected to the outer metal sheathing 26 of conduit 24.

Component 16 extends forward of fitting 18 to tightly enclose, in turn, an elongated cylindrical rear dielectric element 28 of, for example, plytetrafluoroethylene, nylon or other electrically insulative high temperature plastic or the like, a cylindrical thermally insulative lock 30 of ceramic or the like abutting the front end of dielectric element 28 and a sealing cylindrical front dielectric element 32 similar to rear dielectric element 28 and abutting the front end of block 30. A washer 34 of rubber or the like is disposed between rear dielectric element 28 and conduit 24.

Rear dielectric element 28 contains a central metal-lined passageway 36 dimensioned to slideably receive the front end of electrical conductor 38 of conduit 24. The rear end of an electrically conductive center pin 40 is also disposed in passageway 36 at a distance from conductor 38 and extends forwardly through a passageway 42 in block 30 and a passageway 44 in front dielectric element 32. The front end 46 of pin 40 terminates forward of dielectric element 32, as shown in FIG. 1.

Plug 12 also includes a stationary outer shell 48 spaced peripheral of component 16 and secured thereto by a radial retainer 50. In the space 52 between shell 48 and fitting 18 are secured a plurality of forwardly extending resilient, flexible fingers 54, each bearing a pad 56 at the front end thereof. Preferably, six fingers 54 are disposed around the periphery of component 16, as shown in FIG. 1. Fingers 54 extend forward from front dielectric element 32 peripheral of the front end 46 of pin 40.

A gasket 58 is disposed in space 52 against the rear portion of fingers 54 and an O-ring 60 may be disposed in a suitable peripheral recess 62 in component 16. Both gasket 58 and O-ring 60 aid in sealing conductors 38 and 40 against heat, corrosion and the atmosphere.

FIG. 2

Now referring more particularly to FIG. 2 of the accompanying drawing, a preferred embodiment of the female receptacle component of the improved weatherproof, snap-on, positive lock connector device of the present invention is schematically shown therein with the end of a second electrical conduit inserted therein. Thus, device 10 includes female receptacle 64 which has a housing 66. Housing 66 includes a central elongated tubular component 68 which is preferably of metal and has a rear end fitting 70 bearing a central passageway 72 therein adapted to receive the end 74 of an electrical conduit 76. Fitting 70 is adapted to be welded to or otherwise connected to the outer metal sheathing 78 of conduit 76.

Component 68 extends forward of fitting 70 to tightly enclose, in turn, an elongated cylindrical rear dielectric element 80, a cylindrical thermally insulative sealing block 82 abutting the front end of element 80 and a cylindrical front dielectric element 84 similar to rear dielectric element 80 and abutting the front end of block 82. Block 82 is similar in construction to block 30 and elements 80 and 84 are similar in construction to elements 28 and 32. A washer 86 similar to washer 34 is positioned between rear element 80 and conduit 76.

Rear element 80 contains a metal-lined passageway 88 dimensioned to slideably receive the front end of the conductor 90 of conduit 76. The rear end of an electrically conductive center pin 92 is also disposed in passageway 88 at a distance from conductor 90 and extends forwardly through a passageway 94 in block 82 and a passageway 96 in front dielectric element 84. Passageway 96 is lined with metal.

Figure 3:
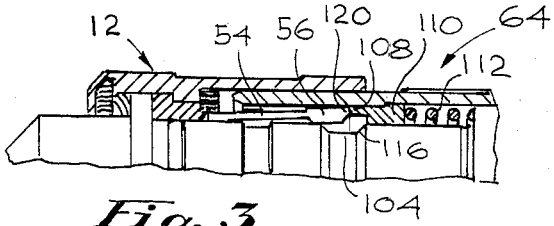
FIG. 3 is a reduced schematic fragmentary side elevation, partly in section, of the plug and receptacle components of FIGS. 1 and 2 during partial engagement therebetween.

Receptacle 64 also includes an outer shell 98 which slides over the outer periphery of fitting 70 and which is spaced peripheral of the front portion 100 of component 68 to form a space 102 therebetween. Space 102 is dimensioned to receive the front portion of shell 48 during engagement of plug 12 with receptacle 64. Portion 100 includes a plurality of peripheral recesses 104 adapted to receive pads 56. Recesses 104 are positioned behind end 106 of component 68 and end 106 is dimensioned such that during engagement of plug 12 with receptacle 64 fingers 54 are spread by contact with the periphery of end 106, as particularly shown in FIG. 3. Such spreading causes fingers 54 to contact the front end 108 of slideable tabs 110 which are biased forward by spring 112. Spring 112 is positioned in space 102, as are tabs 110.

Thus, during engagement of plug 12 with receptacle 64, pads 56 push tabs 110 rearwardly against spring 112 until recesses 104 are accessible to pads 56. Thereupon, pads 56 spring down into and settle in recesses 104. At the moment this occurs, the position of tabs 110 is as shown in FIG. 4. However, spring 112 immediately thereafter forces tabs 110 forward over pads 56, to positively lock pads 56 in recesses 104. This is the position shown in FIG. 5. The entry of pads 56 into recesses 104 is facilitated by contours of surfaces 114 of pads 56, which match the sloping surfaces 116 of recesses 104. When in the locked position, portion 118 of each tab 110 abuts portion 120 of each pad 56 which lies peripheral of the associated recess 104.

When it is desired to unlock plug 12 from receptacle 64, shell 98 is manually moved rearwardly. Tabs 110 are keyed thereto at points 122 and move rearwardly therewith, thus fully exposing recesses 104 and allowing plug 12 to be pulled away from receptacle 64. Since spring 112 is positioned between tabs 110 and fitting 70, rearward movement of shell 98 is against spring 112. After full disengagement of plug 12 from receptacle 64, shell 98 can be allowed to move by the action of spring 112 into the normal forward position shown in FIG. 5.

It will be understood that the described novel positive locking mechanism for device 10 allows plug 12 and receptacle 64 to be fully coupled together and to be locked and unlocked extremely rapidly, but will not unlock inadvertently by vibration or otherwise. This is due to the manner in which the pads 56 are held in recesses 104. When plug 12 and receptacle 64 are fully engaged, that is locked together, end 46 of pin 40 is slideably received within passageway 96 and therefore conduits 24 and 76 are fully electrically interconnected. Moreover, plug 12 fits tightly into receptacle 64 and pins 40 and 92 and conduits 24 and 76 are fully insulated against heat, corrosion and atmospheric conditions. This full insulation is retained throughout the period of connection of plug 12 to receptacle 64. An O-ring 122 is disposed in a peripheral groove 126 in fitting 70 to aid in maintaining this sealing engagement. It will also be noted that the front end of shell 98 is biased by spring 112 into sealing engagement with gasket 58 to also help maintain the desired seal. Thus, device 10 is simple, effective, durable and rapid to connect and disconnect. This can mean a great saving of time and effort and thus a great saving in expense when installation and maintenance of a plurality of cables interconnected by devices 10 are involved. Such is the case with nuclear reactors and other power devices which are particularly subject to corrosive high temperature conditions. Device 10 is inexpensive to fabricate from conventional materials and has other features and advantages as set forth in the foregoing.

Various modifications, changes, alterations and additions can be made in the improved weatherproof, positive lock connector device of the present invention, its components and parameters. All such modifications, changes, alterations and additions as are within the scope of the appended claims form part of the present invention.

What is claimed is:

1. An improved, weatherproof, snap-on, positive lock connector device for electrical conduits, said device comprising, in combination:

a. a male plug comprising a housing having i. a central tubular component having a cavity extending therethrough adapted to receive an electrical conduit at the rear end thereof, ii. a plurality of flexible fingers extending forwardly from the front end of said tubular component, said fingers having terminal pads, iii. a sleeve concentric with and peripheral of said fingers to define with said fingers a peripheral space therebetween, and, iv. sealing means disposed in said space and around said tubular component for thermally sealing said tubular component against atmospheric conditions;

b. a female receptacle comprising a housing having i. a central tubular member having a cavity extending therethrough adapted to receive an electrical conduit at the rear end thereof, ii. a plurality of spaced peripheral recesses in the outer surface of said tubular member aligned with and adapted to receive said fingers, iii. a sleeve concentric with, slideable over and peripheral of said tubular member to define a peripheral space therebetween, said sleeve being receivable within said male plug sleeve, iv. locking means comprising tabs in said female receptacle peripheral space movable between a forward locked position over said recesses and a rearward unlocked position away from said recesses, said tabs being automatically urgeable into said unlocked position by said finger pads during engagement of said male plug and female receptacle, v. spring means urging said locking means into said locked position and said sleeve into a forward position, and;

vi. sealing means for thermally sealing said female receptacle against atmospheric conditions.

2. The improved device of claim 1 wherein said pads and said recesses have sloped matching surfaces to facilitate sliding access of said fingers to said recesses.

3. The improved device of claim 1 wherein said tubular member is of a size to effect radial flexing of said fingers during said engagement and wherein said fingers when in said recesses are in a relaxed state.

4. The improved device of claim 1 wherein said locking means are keyed to and retractable from said locked position with retraction of said female receptacle sleeve from said forward position.

5. The improved device of claim 1 wherein said male plug and said female receptacle are generically cylindrical and wherein said cavities in said tubular component and tubular member are adapted to receive the ends of electrical cable.

* * * * *